United States Patent [19]

Keller

[11] Patent Number: 4,662,183

[45] Date of Patent: May 5, 1987

[54] AUTOMATIC ICE MACHINE

[75] Inventor: Paul P. Keller, Coon Rapids, Minn.

[73] Assignee: Kellex Industries Ltd., San Diego, Calif.

[21] Appl. No.: 851,564

[22] Filed: Apr. 14, 1986

[51] Int. Cl.[4] ..... F25C 1/14

[52] U.S. Cl. ..... 62/138; 62/354

[58] Field of Search ..... 62/137, 138, 353, 354, 62/71

[56] References Cited

U.S. PATENT DOCUMENTS

| | | | |
|---|---|---|---|
| 2,931,193 | 4/1960 | Parisi | 62/354 X |
| 2,982,113 | 5/1961 | Pichler | 62/138 X |
| 3,269,138 | 8/1966 | Hanson et al. | 62/354 X |
| 3,274,792 | 9/1966 | Weil et al. | 62/354 X |
| 4,532,776 | 8/1985 | Arcangeli | 62/354 |
| 4,547,076 | 10/1985 | Maurer | 62/354 X |

*Primary Examiner*—William E. Tapolcai

*Attorney, Agent, or Firm*—James V. Harmon

[57] ABSTRACT

An ice machine is provided for producing cracked ice in which an ice thickness sensor is located within a freezing chamber adjacent to the surface upon which a layer of ice forms during operation. When the thickness sensor is actuated, the layer of ice is harvested. The ice sheet may be removed with a plunger operatively connected to a motor by means of a screw drive.

8 Claims, 9 Drawing Figures

AUTOMATIC ICE MACHINE

FIELD OF THE INVENTION

This invention relates to improvements in ice making equipment and to an apparatus for forming, storing and dispensing cracked ice.

BACKGROUND OF THE INVENTION

The present invention relates to ice making equipment of the general type described in U.S. Pat. Nos. 3,228,202; 4,510,768 and application Ser. No. 677,284, now U.S. Pat. No. 4,604,875, all of which are incorporated herein by reference. While this equipment is very good, there are certain areas in which improvements are possible. In this equipment, an ice sheet produced in an ice forming chamber is transferred at timed intervals to a storage chamber and is simultaneously broken into ice pieces. However, changes in operating conditions may cause the thickness of the ice sheet to vary. Consequently, because of differences in ambient conditions, the thickness of the pieces formed may differ from one time of the day to another or from one machine installation to another. In addition, several other events in the operating cycle were actuated by a timer, i.e., by allowing a predetermined interval of time to elapse before operating various valves and other machine elements. With this method of operation it is possible for certain machine functions to be performed before others have been completed resulting, for example, from a jam-up caused by parts freezing together, etc. Consequently, control of the operation has not always been as positive as desired.

In some of the equipment previously described, ice is transferred from the freezing chamber by a plunger operated with tap water and because excess water must be disposed of, e.g., by allowing it to flow into a storage basin, no more water should be frozen than that volume used to move the plunger during one stroke. If more water than this is required, an overflow basin is needed to store the excess water which upon becoming full will either shut down the machine or spill which is, of course, undesirable. Accordingly, it is an objective to provide a balanced control system wherein the thickness of the ice is always correctly related to the amount of water required to move the plunger as well as a provision for preventing ice sheet thickness fluctuations that might result from variations in ambient conditions. A further object of the invention is to provide an ice sheet transferring mechanism that is not dependent upon tap water for its operation and which will reliably move the ice stripping plunger between two fixed points preferably with the ice stripping action commencing at whatever time interval is required for the ice sheet to build to a predetermined thickness.

These and other more detailed and specific objects of the invention will become apparent in view of the following description setting forth in detail certain illustrative embodiments of the invention by way of example.

SUMMARY OF THE INVENTION

The invention provides a machine for producing cracked ice having a freezing compartment with a freezing surface such as a cylindrical inner wall with a means to distribute water over the freezing surface in the compartment to produce an ice sheet on the freezing surface. A chamber is provided adjacent to the freezing compartment to receive the ice prepared in the freezing compartment and a transferring device is provided to move the ice from the freezing compartment to the ice receiving chamber. A means is provided to detect the thickness of the ice sheet in the freezing compartment and a sensing means is operatively connecting the thickness detecting means and the transfer means to actuate the transfer means when the ice thickness has reached a predetermined value. In a preferred form of the invention, the thickness detecting means is a water drain located adjacent to the freezing surface upon which the ice sheet is formed. The water drain is positioned to be covered by a portion of the ice sheet after the thickness of the ice sheet has increased enough to reach the drain and thereby obstruct it. A sensor is provided to detect a shut off of the water flow through the drain due to obstruction of the drain by the ice sheet. Another feature of the invention is an improved ice transfer means including a transfer plunger having a positioning motor mechanically connected thereto for moving the plunger axially within the ice forming chamber. A further provision of the invention is an improved control whereby the position of machine parts such as the position of the plunger is sensed and used to control the operation of subsequent machine function.

THE FIGURES

DETAILED DESCRIPTION

Figure 1:
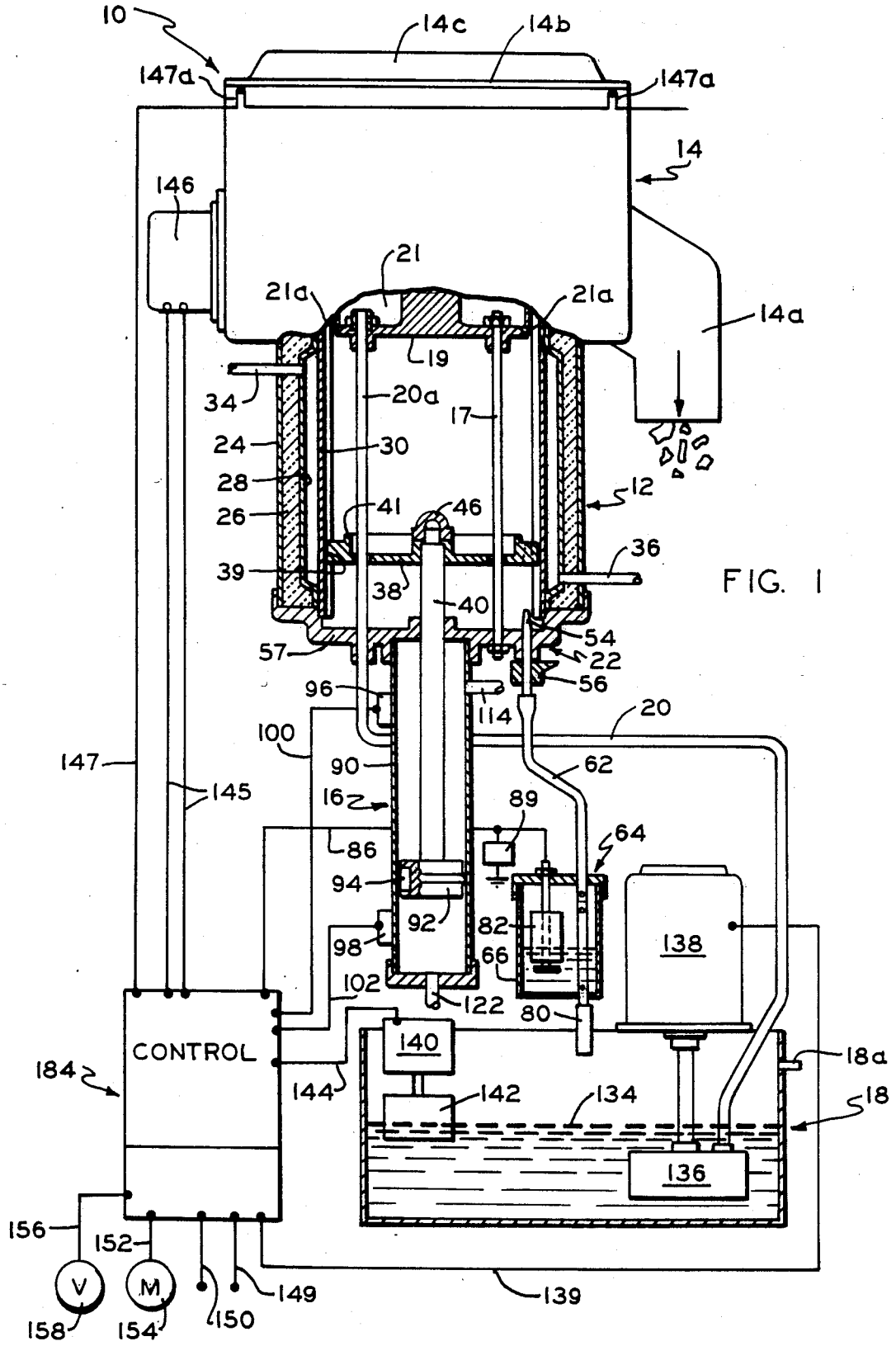
FIG. 1 is a combined side elevational view of the apparatus partly broken away with electrical controls and water pipes shown diagrammatically.
Figure 3:
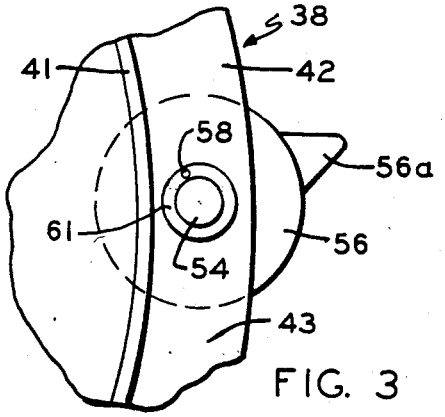
FIG. 3 is an enlarged partial top view of the periphery of the ice stripping plunger and ice thickness sensing unit.

Shown in FIG. 1 is an automatic ice forming machine 10 in accordance with the present invention which includes an insulated ice forming chamber 12 preferably in the form of a vertically disposed cylinder having above it an ice storage chamber 14 within which ice prepared in the ice forming chamber 12 is stored after having been transferred upwardly into chamber 14 by the upward movement of an ice stripping plunger 38 to be described below.

Ice storage chamber 14 includes an ice dispensing outlet **14*a* through ice is ejected, for example, into a plastic cup provided in a drink dispensing machine (not shown) in which the invention is used. The storage chamber 14 also includes a wide top opening 14*b* which is closed during operation by means of a cover 14*c***.

The ice transfer plunger 38 is moved up and down by means of an actuator device in the form of a water operated piston type actuator 16 having an actuator rod 40 projecting upwardly into the chamber 12 and connected at its free end to the plunger 38 for moving it up and down.

The apparatus also includes a water distributing means 19 having a water-filled compartment 21 with water spray jets 21*a* distributed circumferentially on its periphery to disperse water onto the inside surface 30 of the ice forming chamber 12. The water distributing means 19 is supported at the top of the ice forming chamber by means of vertical elements including support rod 17 and a water supply pipe 20*a* which leads from the water supply pipe 20 upwardly through the ice forming chamber 12 to the chamber 21 of the water distributing means 19. In this way, water supplied through pipe 20 passes through the vertically disposed pipe 20*a* which thus has a supporting function for the water dispensing unit 19 as well as supplying water to compartment 21.

The thickness of the ice sheet formed on the interior cylindrical ice forming surface 30 of the ice forming chamber 12 is detected by an ice thickness sensing means indicated generally at 22 to be described in more detail below.

Figure 4:
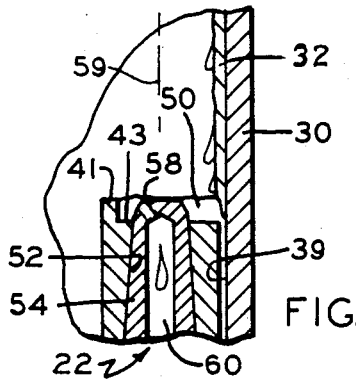
FIG. 4 is a vertical sectional view taken through the ice thickness sensor during the initial stages of ice buildup.
Figure 5:
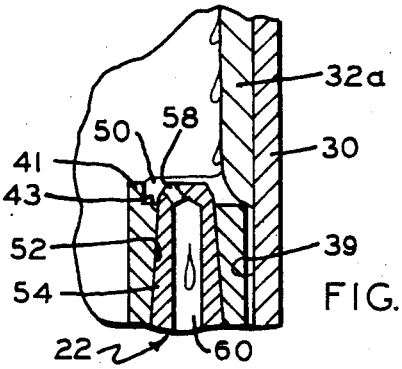
FIG. 5 is a view similar to FIG. 4 showing an ice sheet of greater thickness.
Figure 6:
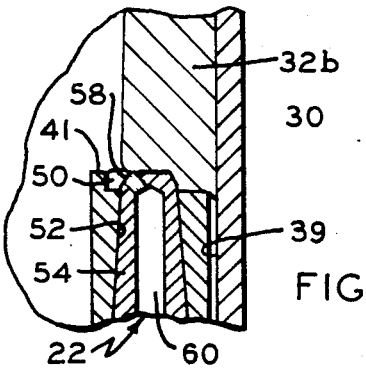
FIG. 6 is a view similar to FIGS. 4 and 5 with the ice sheet thick enough to be detected by the ice sensor.

The ice forming chamber 12 is enclosed within an insulating jacket 24 having an expansion chamber 28 into which refrigerant is introduced and exhausted through lines 34 and 36 respectively. During operation, ice is formed on the interior cylindrical surface 39 of the freezing chamber 30 causing the buildup of an ice sheet 32 as best seen in FIGS. 4–6 which illustrate in sequence successive stages of the growth of a sheet of ice 32 building to a somewhat greater thickness 32*a* and finally to a thickness 32*b* in FIG. 6.

The ice thickness sensing means will now be described in connection with FIGS. 2–6. The ice thickness sensor 22 includes an upright drain member 54 having a tapered outer surface adapted to just fit within a corresponding opening 52 in the periphery of the plunger 38 so that when the plunger 38 is in its retracted, i.e., lowermost position as shown in the figures, the upper end of the drain member 54 will project a short distance out of the top of the plunger 38. The drain member 54 is provided with a drain opening 58 that, in this case, is oriented at an oblique angle and communicates between interior 60 of the drain member 54 and an upwardly facing annular bevel 61 at the top of the member 54. The drain member 54 includes a lower tubular portion 54*a* journaled for rotation as shown at 55 within the bottom wall 57 of the ice forming chamber 12. Secured to the tube 54*a* is an adjustment knob 56 having a pointer 56*a* that can be easily seen. From this description, it will be understood that the rotation of the control knob 56 can be used to rotate drain member 54 about its own vertical axis 59 which is located adjacent to the freezing surface 39 of the ice forming chamber 12. The plunger 38 is provided with an upwardly extending circular peripheral portion with a flat top 43 and an interior vertically projecting circumferentially extending flange 41 to define a water collection trough 50 into which drops of water passing down over the ice sheet 32 collect and are subsequently carried away through the drain opening 58 so long as it is not obstructed by the ice sheet 32. However, when the ice sheet builds to sufficient thickness as shown at 32*b* in FIG. 6, the opening 58 will become obstructed and the flow of water downwardly through the tube 54 will be interrupted.

Figure 2:
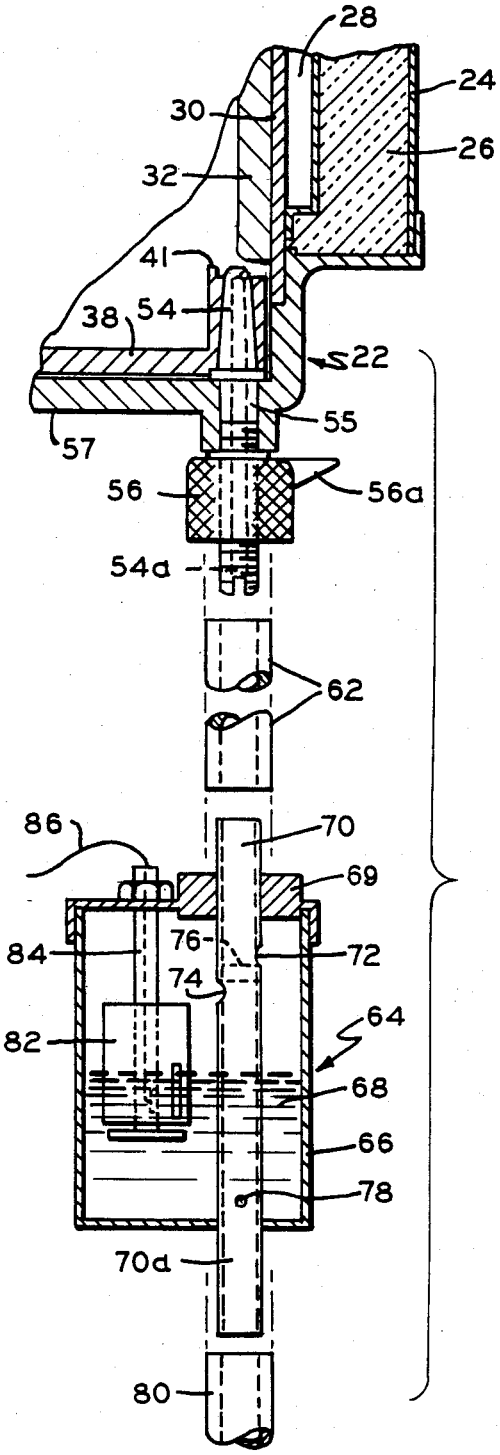
FIG. 2 is an enlarged vertical sectional view of the ice thickness sensing means provided in accordance with the invention.

The means for sensing the thickness of the ice sheet 22 includes a sensor for detecting the flow interruption or cessation of flow of water downwardly through the pipe 54*a*. As shown in FIG. 2, the pipe 54*a* is connected by means of flexible tubing 62 to a pipe 70 of a water flow sensor located generally at 64. The water flow sensor 64 includes a water storage chamber 66 in which water accumulates at 68. A cover is provided at 69. Water introduced through pipe 70 is exhausted through the bottom portion thereof 70*a*. In pipe 70 is provided an inlet aperture 72 and an overflow aperture 74 separated from aperture 72 by means of a plug 76. A relatively small bleed hole 78 is provided to allow for the drainage of the chamber 66 when the ice sheet has built to the required thickness. While the size of various apertures can be varied, it is preferred that the aperture 72 be somewhat larger in size than aperture 78 so that during operation water entering through aperture 72 will quickly collect as shown at 68 until it spills out through the overflow aperture 74, the bleed hole 78 being too small to allow chamber 66 to empty except when the hole 58 is plugged. Mounted within the flow sensor 64 is an electrical switch 84 having a float 82 which, when elevated, will actuate the switch 84 causing a current through the conductor 86 wired to the control 184 as shown in FIG. 1. Water exhausted through the overflow portion 70*a* of pipe 70 is carried by means of a flexible plastic pipe 80 to a water supply tank 18 shown in FIGS. 1 and 8. Thus, during operation, so long as water is flowing through the sensor 22, it will flow into the chamber 66 causing the float 82 to rise actuating the switch 84 allowing the circuit to be completed through the conductor 86. Overflow from the chamber 66 is allowed to be exhausted through outlet port 74. However, as soon as the flow of water from the sensor 22 is interrupted, the relatively small bleed hole 78 will allow the level of the water in the chamber 66 to fall causing the circuit to open through switch 84 thus indicating that the ice layer has grown to the thickness 32*b* of FIG. 6 covering the drain opening 58. The opening of switch 84 will, in turn, initiate other machine functions described below.

Operating of the ice stripping plunger 38 will now be described with reference to FIGS. 1 and 8. As shown in these figures, the actuator 16 comprises a cylinder 90 having a piston 92 connected by means of actuator rod 40 to the plunger 38. Upper and lower magnetic sensors 96 and 98 are positioned adjacent to the cylinder 90 where they will be actuated by a magnet 94 carried in the piston 92 to indicate upper and lower positions of the piston and hence the plunger 38. The sensors 96 and 98 are connected to the control 184 by means of conductors 100 and 102 (FIG. 1).

Figure 8:
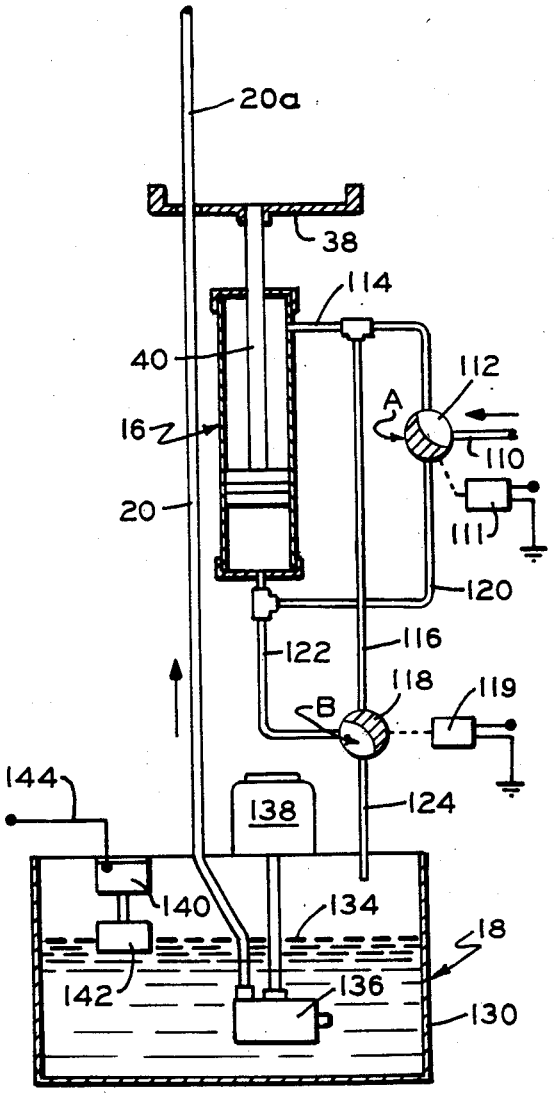

As shown in FIG. 8, water is supplied from the tap through a line 110 and with valves A and B in the positions shown, water will be supplied from the tap line 110 through line 114 to the top of the piston 92 forcing the piston downwardly and, in turn, causing water below the piston to be exhausted through line 122 and 124 into the water supply tank 18. When the valves A and B are reversed, water through line 110 will pass through line 120 causing the piston to rise so that water above the piston 92 will flow through lines 114, 116 and 124 and then to the supply tank 18. The water 134 in the supply tank is forced out through line 20 by pump 136 driven by a motor 138 into the water dispersing unit 19.

The motor 138 is connected by wire 139 to the control 184. The level of water 134 in the supply tank 18 is sensed by means of a float operated switch 140 having a float 142. Switch 140 is wired to the control 184 by means of a conductor 144.

Figure 9:
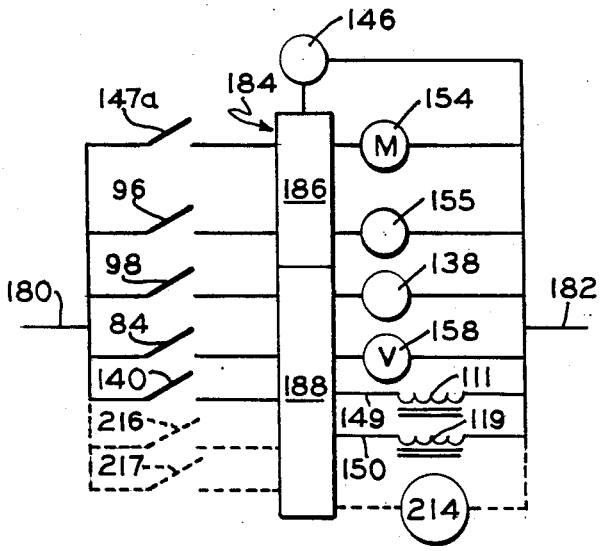
FIG. 8 is a semidiagrammatic view of the major water connections and interconnected plumbing in accordance with the invention and FIG. 9 is a schematic block diagram in accordance with one form of the invention.

The electrical controls will now be described in more detail with particular reference to FIGS. 1 and 9. The dispensing of ice from the supply hopper 14 is carried out by means of a motor 146 wired to the control 184 by electric conductors 145. If the hopper 14 is overflowing with ice, the cover 14*c* will be elevated, activating one or more switches 147*a* connected to the control by means of a conductor 147. As shown in FIG. 9, the piston up and down sensing switches 96 and 98 are connected to energize the control 184. Current is supplied to the switches, motors and control 184 from a power supply (not shown), through conductors 180 and 182. Also wired to the control 184 are the flow sensing switches 84 and the water supply float switch 140. Actuated by the control 184 is a freon compressor motor 154, a refrigerator fan 155 and the water pump 138 used to spray water into the freezing compartment 12. The valves A and B are operated by solenoids 111 and 119 wired between conductor 182 and the control 184 by means of conductors 149 and 150 respectively causing the piston and plunger 38 to move upwardly when energized and causing it to move downwardly when deenergized. In the cycle of operation just before the plunger moves, a hot gas valve 158 wired to the control 184 by means of a conductor 156 is energized to force hot gas rather than cold gas from the compressor through the gas expansion chamber 28 thereby warming the wall 130 to free the hollow cylinder of ice before the plunger 38 begins to travel upwardly.

The control 184 can include suitable logic circuitry and relays for operating at the high voltages required by the motors, valves and solenoids. If desired, the control section 186 can comprise a PAL (programmable array logic) such as a U2556 and the control 188 a PAL such as a U1 and U3. While a variety of control circuits will be apparent to those skilled in the art, a typical circuit is shown in the *Kellex Industries, Ltd. Ice Machine Repair Manual* circuit diagram No. C-000287 which is incorporated herein by reference.

During the first stage of operation, the freezing cycle, the following conditions are required to start making ice. The piston down switch 98 is closed indicating that the plunger 38 is at the bottom of chamber 12 and the hopper switch or switches 147*a* are closed indicating that the hopper 14 is not overflowing with ice. With the circuit energized, the controller 184 will actuate the water pump 138 causing water to be sprayed from dispersing unit 19 covering the inside of the freezing compartment 12 with a sheet of water and at the same time actuating a 60-second timer 89 (FIG. 1) which allows enough time for the water flow switch 82 to close properly from the runoff water collected through the sensor 22. Optionally, a second timing circuit (not shown) can be started to limit the maximum time that the freezing cycle can be active, e.g., 15 minutes. As the freezing cycle progresses, a layer of ice builds up within the chamber 12.

The second phase of the cycle, the ice harvest cycle, begins when either the water flow switch 82 opens or the maximum cycle timer indicates the maximum cycle variation. When either of these conditions occurs, the controller 184 will reset the maximum cycle timer, shut off the water pump 138, turn on the hot gas by actuating valve 158 and activate solenoids 111, 119 driving the piston upwardly to eject the ice in chamber 12 into the hopper 14. The plunger 38 maintains a constant pressure on the ice sheet until the ice sheet is suddenly released from the freezing surface 30. The controller keeps the compressor 154 in operation as long as the gas fed into the expansion chamber 28 remains hot.

The third or reset cycle of operation now begins. During this cycle, when the piston 92 reaches its uppermost position, it is sensed by switch 96 causing the hot gas valve 158 to shut off and the solenoids 111 and 119 are energized to move the piston 92 and plunger 38 downwardly. When the piston 92 reaches the bottom, the next freezing cycle is started as described above. It is important to note that ejection of the ice sheet from chamber 12 to the storage hopper 14 is controlled by the ice thickness as determined by the sensor 22 through the operation of water flow sensing switch 82 during normal operation rather than by means of a timer. In this way, the thickness of the ice sheet at the time it is harvested can be accurately controlled and will not be subject to variations due to ambient conditions.

Figure 7:
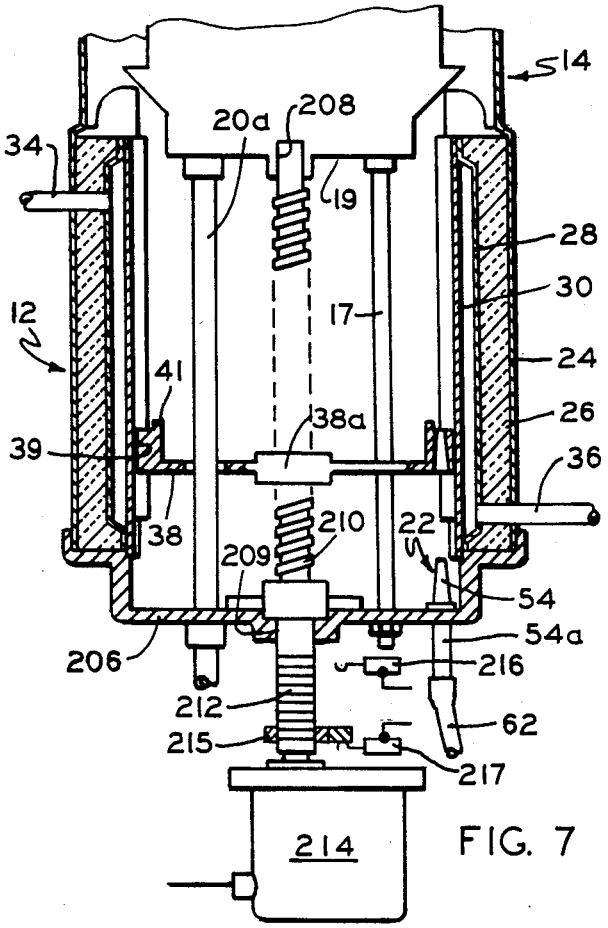
FIG. 7 is a semidiagrammatic vertical sectional view of another form of ice stripping mechanism in accordance with the invention.

Refer now to FIG. 7 which illustrates a modified form of the invention. In FIG. 7, the plunger 38 is driven by means of a motor operated mechanical positioning means, specifically a screw drive 210. As shown in the figure, the vertically disposed screw 210 is aligned diametrically in the center of the cylindrical ice forming chamber 12 in an upright position with its upper and lower ends journaled at 208 and 209 in the water disperser 19 and bottom cover 206 respectively. The plunger 38 is provided with a threaded central aperture 38*a* screw threaded onto the screw 210. The bottom end of the screw 210 is connected to a drive motor 214 and is threaded at 212. A nut 215 travels up and down on the threads 212 as the screw rotates, actuating either up or down sensing switches 216 and 217 respectively. Screw 210 can be provided with a pitch of, say, four threads to the inch while threads 212 have a pitch of 24 to the inch so that the plunger 38 will move the entire length of the cylinder 12 while the nut 215 moves only an inch or two. The motor 214 connected to the lower end of the screw 210 is reversible for driving the plunger 38 in either direction. As shown in FIG. 9, when the screw drive is used, switches 216 and 217 are wired between conductors 280 and control 184 and the motor 214 is connected between control 184 and the conductor 182. The operation is the same as that described above except that switches 216 and 217 replace switches 96 and 98 respectively, and the motor 214 replaces solenoids 111 and 119. Two important advantages were found in the screw drive of FIG. 7. First, the machine is more compact because the actuator 16 is not needed. Second, it was found that there was a great advantage in not having to deal with waste water resulting from piston movement. This can be particularly advantageous in a vending machine with limited capacity for storing overflow water. Thus the device of FIG. 7 can be operated several days longer without requiring attention by a service attendant. If desired, the space previously used by the actuator 16 can be used to increase the size of the ice forming chamber 12 thereby increasing the production capacity typically from about 400 lbs. a day to about 1,000 lbs. a day. It was also found that the screw drive 210 could produce a greater force on the plunger 38 thereby reducing the cycle time and increasing production rates, particularly when water pressure available at the tap is limited.

Any excess water 134 in the tank 18 that is not used up making ice can be withdrawn through an overflow line 18*a*. When the water operated plunger is employed, the maximum cycle time is set typically for 15 minutes so that the ice thickness increases to no more than $\frac{1}{4}$ of an inch even if the sensor 22 fails to operate so that in installations where there is no drain to the sewer, overflow through the pipe 18*a* will not occur. Under the best operating circumstances, the machine will freeze a volume of ice equal or greater than the volume of water that the piston 92 delivers in one stroke. In this way, a balanced system is provided in which the ice thickness is balanced to be slightly greater than the displacement of the piston 92 during one cycle, i.e., two strokes.

Many variations in the scope of the appended claims will be apparent to those skilled in the art once the principles described above are understood.

What is claimed is:

1. A machine for producing cracked ice comprising, a freezing compartment, means to distribute water in the freezing compartment for producing an ice sheet on a surface thereof, a chamber to receive the ice prepared in the freezing compartment, transfer means to move the ice from the freezing compartment to the chamber, means to detect the thickness of the ice sheet in the compartment, means operatively connected between the thickness detecting means and the transfer means to actuate the transfer means when the ice thickness has reached a predetermined level, the thickness detecting means is a water drain located adjacent to the surface upon which the ice sheet is formed and said water drain is positioned to be covered by a portion of the ice sheet after the thickness of the ice sheet has increased enough to reach the drain and thereby obstruct the drain and a sensor means to sense the cessation in the flow of water through the drain due to obstruction by the ice sheet for actuating the transfer means.

2. The apparatus of claim 1 wherein the position of the drain is movable on the apparatus toward or away from the surface upon which ice is formed to control the ice sheet thickness at which the transfer means is actuated.

3. The apparatus of claim 2 wherein the drain has an axially offset drain opening in a member mounted for rotation on an axis adjacent to the surface on which ice is formed whereby selective rotation thereof moves the opening toward or away from said surface.

4. The apparatus of claim 2 wherein a water collection receptacle is provided in the freezing compartment to collect a pool of water and the drain is located in the pool to drain water therefrom until obstructed by the ice.

5. The apparatus of claim 4 wherein said transfer means comprises an ice transfer plunger which is mounted for reciprocation in said freezing compartment and the plunger has said water collection receptacle on its upper surface.

6. The apparatus of claim 5 wherein the receptacle is a trough with a circular flange defining the inner edge thereof.

7. The apparatus of claim 1 wherein the transfer means is a plunger having a hole on the periphery thereof and the sensing means is a drain tube extending upwardly through the hole in the plunger with a drain opening at the top thereof in position to be obstructed by a sheet of ice formed in the freezing compartment for thereby sensing the ice sheet thickness.

8. The apparatus of claim 1 wherein the sensor means to sense the cessation of the flow of water through the drain comprises a water storage chamber connected to the drain wherein water from the drain can collect, a float switch mounted therein to be elevated by the accumulated water and a bleed hole to allow the chamber to empty when the drain becomes plugged by ice thereby causing the actuation of said float switch.

* * * * *